US006463800B2

(12) United States Patent
Fowler

(10) Patent No.: US 6,463,800 B2
(45) Date of Patent: Oct. 15, 2002

(54) ENERGY CONSERVING MOORED BUOYANT OCEAN PROFILER

(75) Inventor: George A. Fowler, Dartmouth (CA)

(73) Assignee: Her Majesty the Queen in right of Canada, as represented by the Department of Fisheries and Oceans, Ottawa (CA)

( * ) Notice: Subject to any disclaimer, the term of this patent is extended or adjusted under 35 U.S.C. 154(b) by 0 days.

(21) Appl. No.: 09/954,191

(22) Filed: Sep. 18, 2001

(65) Prior Publication Data

US 2002/0035870 A1 Mar. 28, 2002

(51) Int. Cl.[7] ..... G01C 13/00; B63B 22/18; B63B 22/20

(52) U.S. Cl. ..... 73/170.29; 441/21; 441/22; 441/23; 441/24; 441/25; 441/26; 441/27; 441/28; 441/29; 441/136; 114/230.1

(58) Field of Search ..... 73/170.29, 170.34, 73/291; 175/5–8, 10; 441/3–5, 21–29, 136; 114/230.1

(56) References Cited

U.S. PATENT DOCUMENTS 3,225,593 A * 12/1965 Richard ..... 73/170.31
3,628,205 A * 12/1971 Starkey et al. ..... 9/8 R
3,983,750 A * 10/1976 Kirkland ..... 73/170 A
4,220,044 A * 9/1980 LeBlanc et al. ..... 73/170 A
4,924,698 A * 5/1990 Echert et al. ..... 73/170 A
5,046,359 A * 9/1991 Layport ..... 73/170 A
5,231,952 A * 8/1993 Tenniswood ..... 116/210
5,644,077 A 7/1997 Fowler
5,869,756 A * 2/1999 Doherty et al. ..... 116/210

FOREIGN PATENT DOCUMENTS

WO WO-95/11158 * 4/1995 ..... 73/170

* cited by examiner

*Primary Examiner*—Hezron Williams
*Assistant Examiner*—Katina Wilson
(74) *Attorney, Agent, or Firm*—Ronald G. Bitner

(57) ABSTRACT

An energy conserving moored buoyant ocean profiler wherein an instrument carrying vertically traversing buoyant member of low buoyancy is interconnected with a second buoyant member of high buoyancy to travel in the opposite direction at lesser distance, such that the potential energy of one buoyant member is increased as the potential energy of the other is decreased, thereby conserving energy as the instrument carrying buoyant member is raised and lowered.

7 Claims, 1 Drawing Sheet

ENERGY CONSERVING MOORED BUOYANT OCEAN PROFILER

BACKGROUND OF THE INVENTION

1. Field of the Invention

This invention relates to an energy conserving moored buoyant ocean profiler

2. Description of the Prior Art

Profiles of temperature and salinity of the upper regions of the ocean are useful for the study of various ocean conditions.

In the Arctic the temperature and salinity of the near surface waters play a significant role in ice formation, movement and eventual decay with attendant climatic consequences. Hence it is desirable to collect data from this region. However, the ice presents a barrier to the collection of continuous long term data.

One approach to the collection of data is to utilize the ice as a supporting surface for suspending instruments. However, the ice is dangerous while it is forming, it usually does not remain stationary, and support is lost when the ice melts.

Another approach that one might consider is to install a subsurface mooring such that the subsurface float is positioned just below the underside of the ice when fully formed. However, the thickness of ice is difficult to predict and is not uniform. Furthermore, the bottom surface of the ice is usually jagged and can damage an instrument or supporting float that contacts it as the ice moves.

The problem of varying ice thickness could be overcome with the use of a winch and ice proximity sensor, such as sonar, to position the instrument to a safe distance from the ice underside. However, it is desirable to obtain data not only from one position immediately beneath the surface, but also from lower regions. Specifically, it would be desirable to be able to profile the top 50 meters, from a bottom point, which could be fixed, to an upper point immediately beneath the ice underside, which is variable due to the irregularity of the ice.

Obtaining profiles near the surface of the open ocean presents similar difficulties. Since the surface of the ocean is almost always in motion, mooring components at or near the surface are subject to oscillating forces that can lead to fatigue failure, and a storm can cause catastrophic failure.

Providing a profiling instrument for continuous long term data collection presents serious difficulties. The major problem is the energy required for raising and lowering the instrument. The instrument must be provided with buoyancy in order to maintain the mooring line in a near vertical position in water currents, and this buoyancy must be overcome by a force applied to the mooring cable by the winch. The energy required for a cycling system of raising and lowering such a buoyant member in a conventional manner, makes such a system impractical.

SUMMARY OF THE INVENTION

An object of the present invention is to provide a system of raising and lowering a subsurface instrument with little energy.

It has been found that an instrument can be raised and lowered to the desired position with little energy by a system utilizing buoyant members in a manner to store energy when the instrument is moved in one direction, to be recovered when moved in the opposite direction.

The present invention provides a moored ocean profiler comprising: a first buoyant member of relatively high buoyancy for mooring to the bottom of a water body by a first mooring line; first drive means associated with the first mooring line for raising or lowering the first buoyant member with respect to the water body bottom; a second buoyant member of relatively low buoyancy for carrying an instrument and attached to a second mooring line; second drive means associated with the second mooring line for raising or lowering the second buoyant member; means operatively interconnecting the first and second drive means such that the direction of travel is in opposite directions to one another, and whereby the ratio of travel distance of the first buoyant member with the travel distance of the second buoyant member is inversely equal to the ratio of the buoyancy of the first and second buoyant member, whereby the potential energy increase or decrease in one buoyant member is equal to the potential energy decrease or increase, respectively, in the other buoyant member; and means for controlling the first and second drive means.

DESCRIPTION OF THE PREFERRED EMBODIMENTS

Figures 1A, 1B, 1C:
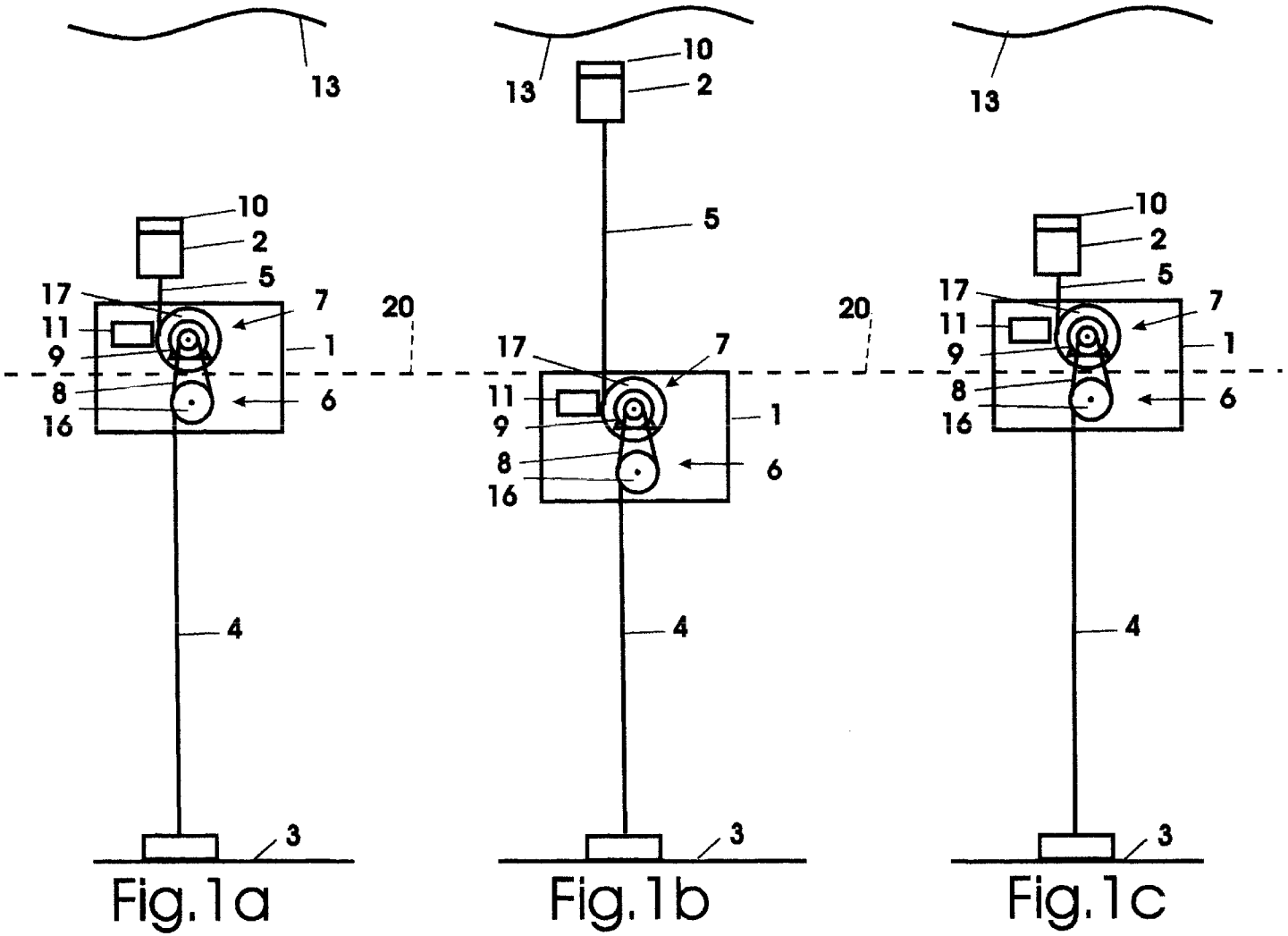
FIG. 1 is a schematic representation of one embodiment of the invention, showing the apparatus in different states, a, b, and c.

With reference to FIG. 1, the present invention comprises two buoyant members 1 and 2. A first buoyant member 1 of relatively high buoyancy is moored to the bottom 3 of a water body by a first mooring line 4, while a second buoyant member 2 of relatively low buoyancy is attached to a second mooring line 5. The second buoyant member supports the desired profiling instrument 10.

The first buoyant member 1 and the second buoyant member 2 are positioned by means of first drive means 6 and second drive means 7.

The first drive means 6 includes a winch 16 associated with the first mooring line 4 for raising or lowering the first buoyant member 1 relative to the water body bottom 3.

The second drive means 7 includes a second winch 17 associated with the second mooring line 5 for raising or lowering the second buoyant member 2 with instrument 10.

The first and second drive means are operatively interconnected by suitable means, shown schematically in the form of a chain or belt 8, and shown powered by a single common motor 9. The buoyant members are interconnected such that the direction of travel of the buoyant members are in opposite directions to one another. Specifically, when the winch 17 is paying out line 5, winch 18 is hauling in line 6, and vice versa.

The ratio of travel distance of the first buoyant member 1 with the travel distance of the second buoyant member 2 is arranged to be inversely proportional to the ratio of the buoyancy of the first and second buoyant member. This provides that the potential energy increase or decrease in one buoyant member is equal to the potential energy decrease or increase, respectively, in the other buoyant member.

As can be seen by comparing FIGS. 1*a* and 1*b*, buoyant member 2, with instrument 10 moves relatively large distances as compared with that of buoyant member 1. The smaller motion of buoyant member 1 can be seen with reference to the reference line 20.

The arrangement of non-equal buoyant members provides a number of advantages. One advantage is that the instrument carrying buoyant member 2 can travel greater distances without being limited by the length of mooring line 4, since with this arrangement the other high buoyancy member 1 will travel relatively short distances. Another advantage obtained from such shorter travel distances is reduced drag and hence less energy loss.

It will be appreciated that various means may be used for paying out and hauling in of the lines 4 and 5 with the desired ratio, and may include various known types of mechanical mechanisms. For example, gearing could be used instead of different diameters drums/winches, as illustrated schematically in the drawings, to provide the desired differential motion of the lines. The mechanism may also include means to correct for the effective changes in diameter resulting from multi-level winding on the drum/winch.

The ideal relationship of buoyancies and travel distance can be stated as follows:

$$B_2 \times D_2 = B_1 \times D_1,$$

where $B_2$=Buoyancy of upper, smaller, buoyant member 2

$B_1$=Buoyancy of lower, larger, buoyant member 1

$D_2$=Distance travelled by smaller, buoyant member 2

$D_1$=Distance travelled by larger, buoyant member 1

With the present arrangement, as illustrated in FIG. 1, the drive means is mounted on the moving buoyant member 1, and the buoyancy force of buoyant member 2 is transmitted through buoyant member 1, such that the tension on mooring cable 4 is $B_1+B_2$. Accordingly, with such arrangement, the relationship of buoyancies and travel distance is:

$$B_2 \times D_2 = (B_2 + B_1) \times D_1$$

For a desired travel ratio R (travel distance of the buoyant member 2/travel distance of the buoyant member 1), the buoyancy ratio is:

$$B_2 \times RD_1 = (B_2 + B_1) \times D_1$$

For a desired travel ratio R of 10, for example, $B_1=9B_2$

The above is correct for a static system. However, the system efficient. Mechanical losses alter the torque when the mechanism rotates and in the embodiment tested, the torques were found to be different for paying out and hauling in.

For optimum operation, it may be desirable that torques, or motor currents, be approximately equal for paying out and hauling in. It was found that the unequal torques can be equalized by altering the buoyancy ratio or the travel ratio. For the embodiment tested and for a desired movement ratio of 10, it was found that a buoyancy ratio of 8.22 $B_2=B_1$ provided equal torques for paying out and hauling in. Although such adjustment results in the system being statically unbalanced, this was found not to be a problem since the system is internally braked when the motor is not running.

It will be understood that other systems would have different characteristics in operation, and hence the optimum ratio would also be different.

The raising and lowering of the instrument carrying buoyant member means can be controlled by suitable control means in conjunction with the instrument 10 as required for the profiling operation. For example, the control means may include sonar to determine the proximity of the instrument with the surface of the ocean, or the underside of ice, 13, and position the instrument accordingly. The mooring line 5 may be used to carry power and/or signals between the instrument, along with any other desired components 10, on the traversing buoyant member 2 and the components 11 mounted on the buoyant member 1. The components 11 may include the battery and control means for controlling activation of the drive means 6 and 7, and the motor 9.

In one stage of operation, it is desired to position the instrument near the surface of the ocean, or the underside of the ice, 13, as shown in FIG. 1(*b*). From a previous position as shown in FIG. 1(*a*), it can be seen that the instrument carrying buoyant member 2 has been raised, while the high buoyancy member 1 has lowered.

As the buoyant member 2 is raised it loses potential energy, but the same amount of energy is gained by the buoyant member 1 as it is lowered. As described above, this is made possible by arranging that the ratio of travel distance of the first buoyant member 1 with the ratio of travel distance of the second buoyant member 2 is inversely proportional to the ratio of the buoyancy of the first and second buoyant member.

In a subsequent profiling step, as shown in FIG. 1(*c*), the instrument carrying buoyant member 2 has been lowered, while the high buoyancy member 1 has been raised. Again, the counter balancing of forces of the buoyant members means that little energy is consumed.

The present invention can be used to obtain a temperature and salinity profile in an upper region of the ocean, or under the ice. The apparatus can be controlled to cycle between predetermined lower and upper points. The lower point can be fixed, while the upper point can be variable to accommodate ocean surface conditions, or irregularities of the ice underside. Sonar may be utilized to control or limit the positioning of the instrument relative to the ocean surface, or ice underside, to prevent the instrument from contacting and being damaged by the underside of the ice or ocean waves.

For profiles in the open ocean, the system may include an acoustic sensor for determining ocean surface conditions, for example, by sensing ambient noise. Thereby, if conditions permit, the instrument may be sent to the surface to facilitate sending data, for example, via satellite link.

What is claimed is:

1. A moored ocean profiler comprising:

a first buoyant member of relatively high buoyancy for mooring to the bottom of a water body by a first mooring line;

first drive means associated with the first mooring line for raising or lowering the first buoyant member with respect to the water body bottom;

a second buoyant member of relatively low buoyancy for carrying an instrument and attached to a second mooring line;

second drive means associated with the second mooring line for raising or lowering the second buoyant member;

means operatively interconnecting the first and second drive means such that the direction of travel is in opposite directions to one another, and whereby the ratio of travel distance of the first buoyant member with the travel distance of the second buoyant member is inversely equal to the ratio of the buoyancy of the first and second buoyant member, whereby the potential energy increase or decrease in one buoyant member is equal to the potential energy decrease or increase, respectively, in the other buoyant member; and means for controlling the first and second drive means.

2. The device of claim 1, wherein the first drive means includes a first winch and the second drive means includes a second winch.

3. The device of claim 1, wherein the first drive means and the second drive means are interconnected with a common motor.

4. The device of claim 1, further comprising sensing means for determining the position of the upper surface of the water body and control means responsive to the sensing means for controlling activation of the drive means.

5. The device of claim 1, wherein the first drive means and the second drive means are mounted on the first buoyant member.

6. The device of claim 5, wherein the relationship of buoyancies and travel distance is $$B_2 \times D_2 = (B_2 + B_1) \times D_1,$$

where $B_2$=Buoyancy of the second buoyant member $B_2$=Buoyancy of the first buoyant member $D_2$=Distance travelled by the second buoyant member $D_1$=Distance travelled by the first buoyant member.

7. The device of claim 3 wherein the buoyancy of the fir and second buoyant members and the ratio of travel distance is selected to provide equal torque for the motor for both directions of travel.

* * * * *